US005566630A

United States Patent [19]

Burgess et al.

[11] Patent Number: 5,566,630

[45] Date of Patent: Oct. 22, 1996

[54] IN-LINE NEEDLE BAR ARRANGEMENT FOR TUFTING MACHINES

[75] Inventors: Clyde Burgess, Dalton; Gerald Morrison, Ringgold, both of Ga.; M. Steven Berger, Chattanooga, Tenn.

[73] Assignee: Durkan Patterned Carpets, Inc., Dalton, Ga.

[21] Appl. No.: 213,178

[22] Filed: Mar. 14, 1994

[51] Int. Cl.[6] ..... D05C 15/30

[52] U.S. Cl. ..... 112/80.41

[58] Field of Search ..... 112/80.01, 80.23, 112/80.4, 80.41, 80.45, 80.7, 80.73, 266.2; 66/208; 28/113

[56] References Cited

U.S. PATENT DOCUMENTS

| | | | |
|---|---|---|---|
| 2,842,080 | 7/1958 | Hoeselbarth . | |
| 2,850,994 | 9/1958 | Crawford . | |
| 3,019,748 | 2/1962 | Card . | |
| 3,095,840 | 7/1963 | Ballard . | |
| 3,095,841 | 7/1963 | Ballard et al. . | |
| 3,138,126 | 6/1964 | Card . | |
| 3,162,155 | 12/1964 | Charles . | |
| 3,396,687 | 8/1968 | Nowicki . | |
| 3,633,523 | 1/1972 | Card . | |
| 3,850,120 | 11/1974 | Jackson . | |
| 3,943,865 | 3/1976 | Short et al. | 112/80.73 X |
| 4,226,196 | 10/1980 | Booth . | |
| 4,267,787 | 5/1981 | Fukuda | 112/80.73 X |
| 4,398,479 | 8/1983 | Czelusniak, Jr. . | |
| 4,574,716 | 3/1986 | Czelusniak, Jr. | 112/80.45 |
| 4,637,329 | 1/1987 | Czelusniak, Jr. | 112/80.45 |
| 4,790,252 | 12/1988 | Bardsley | 112/266.2 X |
| 4,800,828 | 1/1989 | Watkins | 112/80.41 |
| 4,815,403 | 3/1989 | Card et al. | 112/80.41 |
| 5,058,518 | 10/1991 | Card et al. | 112/266.2 |
| 5,193,472 | 3/1993 | Crossley | 112/80.41 |

*Primary Examiner*—Paul C. Lewis
*Attorney, Agent, or Firm*—Pitts & Brittian, P.C.

[57] ABSTRACT

An in-line needle bar arrangement for tufting machines (10) for tufting a selected fabric. A pair of needle bars (12A,B) are provided with registered faces (20) configured to engage one another such that the needles (14) carried thereby are positioned to define a single row of needles (14). Each one of the needles (14) is substantially similar to each of the others such that only one configuration of needle (14) is required. A plurality of filaments (16) are provided, one each for one each of the plurality of needles (14). Each filament (16) is engaged by one of at least two feed control rollers (18). Each of the rollers (18) is controlled independently from the other in order to accomplish different feed rates by each. By varying the feed rate of the yarn (16), the pile height is proportionately varied, thus varying the pile height of the respective tufts. A master control (24) is provided for coordinating the control of each of the individual rotation imparting devices (22) and the relative and combined movements of the individual needle bars (12A,B). A needle bar spacing device (42) is provided for moving the down-line needle bar (12B) out of and into engagement with the up-line needle bar (12A). When spaced apart, one or both of the needle bars (12A,B) may be transversely adjusted as required.

15 Claims, 3 Drawing Sheets

IN-LINE NEEDLE BAR ARRANGEMENT FOR TUFTING MACHINES

TECHNICAL FIELD

This invention relates to the field of tufting machines. More specifically, this invention relates to a tufting machine having a plurality of separably operable needle bars, each of the needle bars being positionable in relationship to each other to form a single row of needles.

BACKGROUND ART

In the field of tufting, it is well known that more than one needle bar may be required in order to accomplish a particular pattern of color and/or texture on the top side of the carpet. In order to accomplish this, the needle bars are spaced apart one from the other in the direction of travel of the backing material. By so spacing the needle bars, each may move independently of the other in a transverse direction with respect to the backing material. In order to prevent the individual needles from colliding with the corresponding hooks provided for catching and/or cutting the yarn pressed through the backing material, the needle bars are staggered at specific increments such that the needles are staggered. For example, the individual needles carried by each needle bar are spaced two units apart. The needle bars are staggered in a transverse direction by one unit. Thus, looking at the needle carried by both needle bars in the direction of travel of the backing material, the needles are spaced apart a distance of one unit.

Due to the distance between the needle bars, distinct patterns are difficult to attain. The forward needle bar has completed its portion of the pattern for at least one row of tuft before the rearward needle bar is able to complete the pattern on that row. In effect, it is well known that this stagger creates a transition between patterns. This stagger is most obvious in patterns wherein squares, such as in a checkerboard pattern, are attempted. At least two of the corners are typically truncated. This is also noticeable in the transition from a high pile to a low pile texture. It is well known that this transition typically produces a smooth curve effect as opposed to a distinct change in pile height between two consecutive loops.

Other tufting machines have been produced to allow for increased performance capabilities in the manufacture of patterned carpet. Typical of the art are those devices disclosed in the following U.S. Patents:

| U.S. Pat. No. | Inventor(s) | Issue Date |
|---|---|---|
| 2,842,080 | F. W. E. Hoeselbarth | Jul 8, 1958 |
| 2,850,994 | A. H. Crawford | Sep 9. 1958 |
| 3,019,748 | J. L. Card | Feb 6, 1962 |
| 3,095,840 | W. H. Ballard | Jul 2, 1963 |
| 3,095,841 | W. H. Ballard, et al. | Jul 2, 1963 |
| 3,138,126 | R. T. Card | Jun 23, 1964 |
| 3,162,155 | A. E. Charles | Dec 22, 1964 |
| 3,396,687 | H. F. Nowicki | Aug 13, 1968 |
| 3,633,523 | R. T. Card | Jan 11, 1972 |
| 3,850,120 | O. R. Jackson | Nov 26, 1974 |
| 4,226,196 | D. Booth | Oct 7, 1980 |
| 4,398,479 | P. A. Czelusniak, Jr. | Aug 16, 1983 |
| 4,800,828 | C. W. Watkins | Jan 31, 1989 |
| 5,058,518 | R. T. Card, et al. | Oct 22, 1991 |
| 5,193,472 | P. H. Crossley | Mar 16, 1993 |

Of these devices, those disclosed by Hoeselbarth ('080), Crawford ('994), Ballard ('840), Ballard, et al. ('841), Card ('126), and Charles ('155) are directed toward devices designed to allow variation of the pile height to create a contoured carpet. The Card ('126) device is specifically designed to fabricate cut pile carpet having high- and low-cut pile. None of these references teaches the use of a plurality of independently-operable needle bars for creating a selected pattern.

The remainder of the prior art references disclose various devices, each incorporating a pair of needle bars which may be moved with respect to one another. Typically, as illustrated by Card ('748), Nowicki ('687), Card ('523), Jackson ('120), Booth ('196), Watkins ('828), Card, et al. ('518), and Crossley ('472), the individual needle bars are spaced apart in the direction of travel of the backing material. The needle bars may thus be moved transversely to approximate a selected pattern. Nowicki best illustrates the typical patterns achievable by these types of devices. FIGS. 16–18 therein illustrate the "footprints" of the two needle bars as they move independently of each other. FIG. 16 illustrates the movement of the two needle bars in opposite directions at all times. FIG. 17 illustrates movement of both in opposite directions for two steps and in the same direction for two steps. FIG. 18 illustrates one needle bar moving left and right with the second needle bar remaining in one position.

FIGS. 8–11 of the Nowicki disclose the use of varying the pile height to hide particular filaments in a selected portion of the pattern. Typically, the variation of the pile height is accomplished through the selection of the looper member, or hook, associated with a particular needle. Alternatively, this may be accomplished by using a pattern wheel which controls the depth of penetration of the individual needles into the backing material.

The device taught by Czelusniak, Jr. ('479) includes a pair of needle bars which are indexed such that the two rows of needles carried by the individual needle bars are aligned to form a single row of needles. The two individual needle bars are held in abutment in the lower portion of the needle stroke using a tension spring member. At the top of the stroke, a lever is engaged to separate the two needle bars one from the other. A pattern means then shifts the needle bars as required to accomplish the selected design. The two needle bars attached at their respective ends in essentially a loop configuration such that as one is moved in one direction, the other is moved in the opposite direction an equal distance. Czelusniak does not disclose a device for varying the pile height for selected tufts. Nor does Czelusniak disclose a device for tufting fabrics using two needle bars collectively as either of an in-line needle bar or a pair of staggered needle bars. The Czelusniak device may only be used in an in-line needle bar application as the needle bars remain biased one toward the other. When in the in-line position, the Czelusniak disclosure fails to provide a means whereby the spacing between the individual needles is accurately maintained. The needles 44 are received between boss portions **43*b*, to each of which is mounted a needle 45. Needles 44 and needles 45 are of different lengths due to this configuration, and needles 44 are at a high risk of breakage if the needle bars 42 and 43 are moved toward one another such that the needles 44 engage the terminal portion of the boss portions 43*b***.

None of the prior art devices show the use of a dual needle bar arrangement as both a standard two needle bar configuration and an in-line configuration. Further, none of the prior art references discloses the use of a dual needle bar arrangement in an in-line fashion wherein the movement of each needle is independent of the movement of the other.

Therefore, it is an object of this invention to provide a means for tufting a selected fabric wherein at least two needle bars are used, the needle bars being provided with registered faces for receiving one another such that the needles carried by both needle bars are positioned to define a single row of needles.

Further, it is an object of the present invention to provide a means for moving each needle bar in a transverse direction of the travel of the selected fabric, each needle bar being moved independently of the other.

Another object of the present invention is to provide at least one means for controlling the rate of feed of a plurality of filaments to be tufted into the selected fabric.

Still another object of the present invention is to provide a means for independently controlling the feed rate of a plurality of groups of filaments to be tufted.

Yet another object of the present invention is to provide a means whereby the needles carried by each needle bar in the plural needle bar configuration are each substantially similar one to another.

Still another object of the present invention is to provide a means for protecting the needles carried by each needle bar when the needle bars are being positioned to define an in-line needle bar.

DISCLOSURE OF THE INVENTION

Other objects and advantages will be accomplished by the present invention which serves to tuft a selected fabric wherein at least two needle bars are used, the needle bars being provided with registered faces for receiving one another such that the needles carried by both needle bars are-positioned to define a single row of needles. The in-line needle bar is designed to be alternatively used in a conventional dual needle bar arrangement with the two needle bars spaced apart to form two rows of needles.

In an in-line arrangement, two needle bars are engaged one with the other such that one row of needles is defined. Each one of the needles is substantially similar to each of the others such that only one configuration of needle is required. The needles are thus interchangeable between the needle bars. A plurality of filaments is provided, with one each of the filaments being individually threaded through an eye in each of the needles. Prior to being threaded through the respective needle eyes, the filaments are engaged by a feed control device such as rollers. The yarn is wound around the rollers in a manner such that as the roller is selectively rotated, the yarn is fed to the needles. Each of the rollers is controlled independently from the other in order to accomplish different feed rates by each. By varying the feed rate of the yarn, the pile height is proportionately varied, thus varying the pile height of the respective tufts.

Rotation imparting devices are provided for imparting rotation to each of the rollers, with one each of the individual rotation imparting devices being provided for one each of the individual rollers. A master control such as a computer is provided for coordinating the control of each of the individual rotation imparting devices. The master control also serves to control the relative and combined movements of the individual needle bars. The master control has embedded within itself the selected pattern to be tufted, and can have a plurality of patterns stored. From this information, the master control determines the parameters of the rotational movement of each of the rollers, as well as the timing and magnitude of the movements of the individual needle bars.

The rollers are positioned such that each is substantially parallel to the needle bars. The rollers are rotated in selected increments or at selected rates in order to control the feed of the yarn to the needle bars. During operation of the tufting machine, the feed rate of the yarns may be varied in order to vary the pile height achieved with the particular group of yarns fed to the needle bars thereby. It may be desirable to achieve varied pile heights within the span of one of the needle bars. Therefore, the yarns fed by a single roller may be fed to both of the needle bars. Each roller is capable of feeding all of the yarns necessary for the tufting operation.

The down-line needle bar is moveable in the direction of travel of the backing material, away from the up-line needle bar. When spaced apart, one or both of the needle bars may be transversely adjusted as required. Each of the needle bars defines a registered face provided with a plurality of linearly spaced apart protrusions vertically oriented from the top surface of the needle bar to the bottom surface thereof. Each protrusion defines an opening for closely receiving one of the needles. The protrusions defined by one needle bar are indexed to be closely received within the spaces defined by the protrusions in the other needle bar. In order to facilitate slight error in the transverse movement of the needle bars, the protrusions are provided with beveled corners. As the needle bars are brought into engagement one with the other, the beveled corners serve to move one or both of the needle bars such that they may properly register one with the other.

A needle bar spacing device is provided for moving the down-line needle bar out of and into engagement with the up-line needle bar. At least one servo motor is provided for moving the needle bar as required. The arrangement and connection of the servo motor is such that the down-line needle bar is capable of movement away from the up-line needle bar and transversely.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An in-line needle bar arrangement for tufting machines incorporating various features of the present invention is illustrated generally at 10 in the figures. The in-line needle bar arrangement for tufting machines, or in-line needle bar 10, is designed for tufting a selected fabric wherein at least two needle bars 12 are used, the needle bars 12 being provided with registered faces 20 for receiving one another such that the needles 14 carried by both needle bars 12 are positioned to define a single row of needles 14. Moreover, in the preferred embodiment the in-line needle bar is designed to be alternatively used in a conventional dual needle bar arrangement with the two needle bars 12 spaced apart to form two rows of needles 14.

Figure 1:
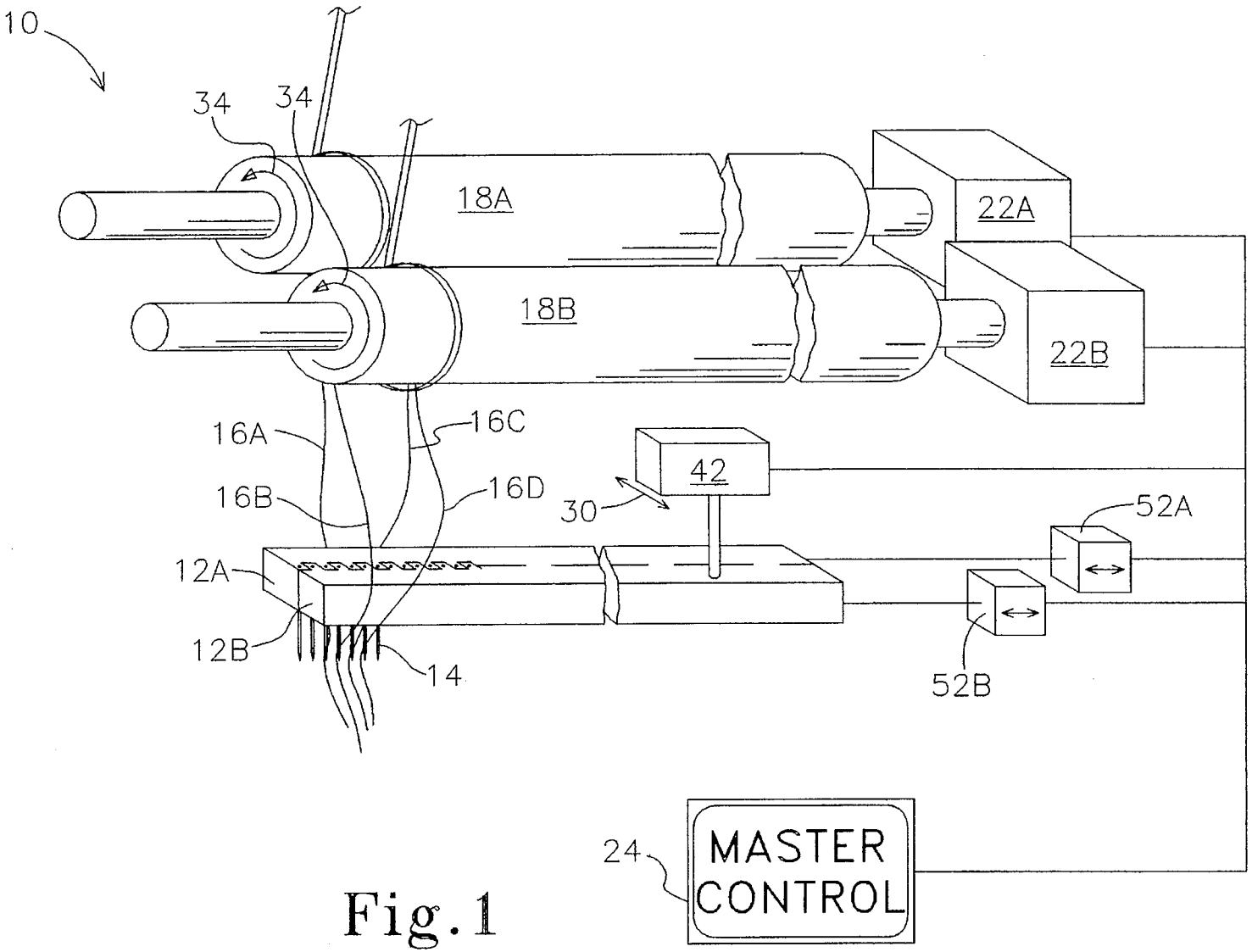
FIG. 1 is a perspective view of the in-line needle bar arrangement for tufting machines constructed in accordance with several features of the present invention.

FIG. 1 illustrates the in-line needle bar 10 of the present invention, with a major portion of the tufting machine removed. It will be understood that the tufting machine on which the present invention may be incorporated may be any conventional tufting machine, with modifications hereinafter disclosed being made to adapt for such incorporation. In FIG. 1, two needle bars 12A,B are shown in engagement one with the other such that one row of needles 14 is defined. Each one of the needles 14 is substantially similar to each of the others such that only one configuration of needle 14 is required. By providing for only one type of needle 14, it will be understood that the needles 14 are interchangeable between the needle bars 12A,B.

A plurality of filaments 6 is provided, with one each of the filaments 16 being individually threaded through an eye in each of the needles 4. Prior to being threaded through the respective needle eyes, the filaments 16 are engaged by a feed control device 18 such as the rollers illustrated. In the preferred embodiment, the yarn 6 is wound around the rollers 18 in a manner such that as the roller 18 is selectively rotated, the yarn 16 is fed to the needles 14. In the illustrated embodiment, two rollers 18 are provided for controlling the feed rate of the yarn 16 toward the needles 14. It will be understood that more or fewer may be provided as required. Each of the rollers 18 is controlled independently from the other in order to accomplish different feed rates by each. By varying the feed rate of the yarn 16, the pile height is proportionately varied. Thus, by having a number of filaments being fed at one rate and a number of filaments 16 being fed at another rate, the pile height of the respective filaments 16, when tufted, will be dependent on their respective feed rates. It is thus seen that various pile heights are accomplished simultaneously. Further, the variation in pile height is accomplished in the same row of tufting.

A rotation imparting device is schematically shown at 22 for imparting rotation to each of the rollers 18. As shown, an individual rotation imparting device 22 is provided for each of the individual rollers 18. A master control 24 such as a computer is provided for coordinating the control of each of the individual rotation imparting devices 22. The master control 24 also serves to control the relative and combined movements of the individual needle bars 12A,B. The master control 24 has embedded within itself the selected pattern to be tufted. From this information, the master control 24 determines the parameters of the rotational movement of each of the rollers 18, as well as the timing and magnitude of the movements of the individual needle bars 12A,B.

Figure 2:
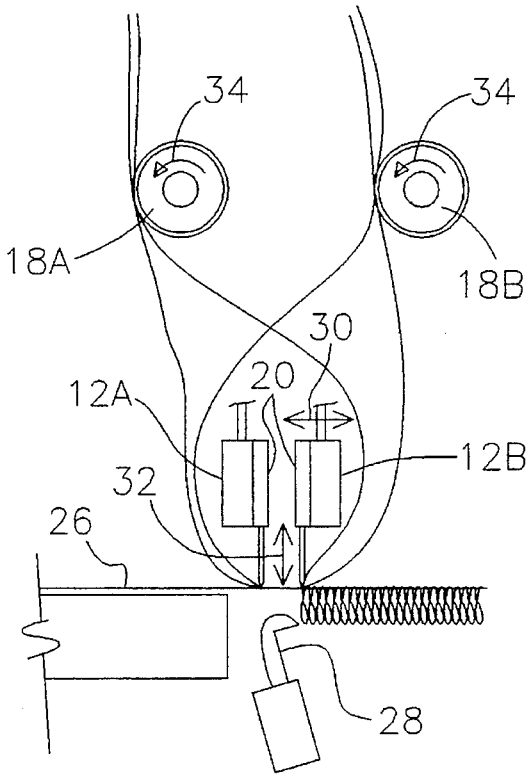
FIG. 2 illustrates an end view of the in-line needle bar arrangement for tufting machines of FIG. 1 showing the relative movements of each of the yarn feed rollers and needle bars.

FIG. 2 more clearly illustrates the arrangement of the needle bars 12A, B, rollers 18, yarns 16, backing material 26 and hooks 28. As illustrated, one of the needle bars 12B is movable with relation to the other of the needle bars 12A. In the preferred embodiment, the down-line needle bar 12B is moveable in the direction of travel of the backing material 26, away from the up-line needle bar 12A. When spaced apart as illustrated, one or both of the needle bars 12A,B may be transversely adjusted as required to achieve the desired pattern. The direction of movement of the down-line needle bar 12B with respect to the up-line needle bar 12A is indicated generally by the double-headed arrow 30. The direction of travel of both needle bars 12A,B in the tufting stroke is indicated generally by the double-headed arrows 32.

The rollers 18 are shown to be positioned such that each is substantially parallel to the needle bars 12A,B. It is envisioned that other arrangements may be devised as required. As shown generally by the arrows 34, the rollers 18 are rotated in selected increments or at selected rates in order to control the feed of the yarn 16 to the needle bars 12A,B. As indicated previously, the feed rate is a factor in determining the pile height. During operation of the tufting machine, the feed rate of the yarns 16 may be varied in order to vary the pile height achieved with the particular group of yarns 16 fed to the needle bars 12A,B thereby. Further, although not shown, more than the illustrated two rollers may be provided for achieving the tufting of more than two distinct pile heights within the same row of tufting. The control of the additional rollers 18 is similar to that described above.

It may be desirable to achieve varied pile heights within the span of one of the needle bars 12A,B. Therefore, as illustrated, the yarns 16 fed by a single roller 18 may be fed to both of the needle bars 12A,B. From roller 18A are fed yarns 16A,B. Yarn 16A is fed to a selected needle 14 carried by the up-line needle bar 12A while the yarn 16B is fed to the down-line needle bar 12B. Similarly, from roller 18B are fed yarns 16C,D, with yarn 16C being fed to a selected needle 14 carried by the up-line needle bar 12A and the yarn 16D being fed to the down-line needle bar 12B. It may be desirable to only feed a few yarns 16 by one of the rollers 18A,B, with the other roller 18A,B feeding the remainder. Therefore, it is preferred that each roller 18 be capable of feeding all of the yarns 16 necessary for the tufting operation.

FIG. 2 further illustrates a cooperating row of hooks 28 provided in the conventional tufting machine for catching the yarn 16 pressed through the backing material 26. The hooks 28 may be any conventional configuration and may be provided for fabricating loop or cut pile, or a combination of both.

Figure 3:
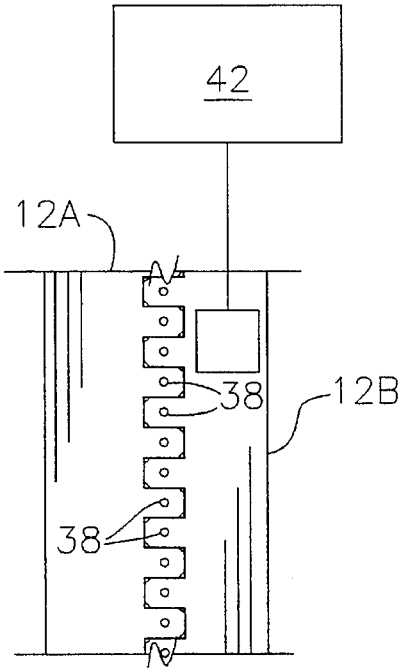
FIG. 3 is a top plan view of a portion of the needle bars of the present invention showing engagement between the needle bars to define an in-line configuration thereof, thus defining a single row of needles.
Figure 4:
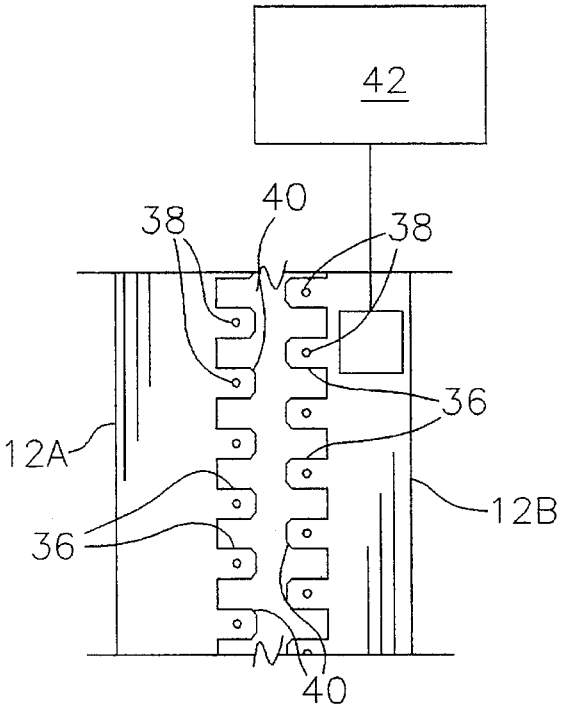
FIG. 4 is a top plan view of a portion of the needle bars of the present invention showing separation of the needle bars one from the other to define a staggered configuration thereof, thus defining two rows of needles.

A top plan view of a portion of the needle bars 12A,B is illustrated in FIGS. 3 and 4. FIG. 3 depicts the needle bars 12A,B in engagement one with the other. It is clearly seen that the needles 14 carried by both of the needle bars 12A,B form a single row. FIG. 4 illustrates the same portion of the needle bars 12A,B with the down-line needle bar 12B moved away from the up-line needle bar 12A. In this position, either or both of the needle bars 12A,B may be moved transversely with respect to the backing material and independently of each other. Further, if the down-line needle bar 12B is kept in this spaced apart relationship with the up-line needle bar 12A, the needle bars 12A,B may be used in a conventional dual needle bar application.

As best illustrated in FIG. 4, each of the needle bars 12A,B define a registered face 20 provided with a plurality of linearly spaced apart protrusions 36 vertically oriented from the top surface of the needle bar 12 to the bottom surface thereof. Each protrusion 36 defines an opening 38 in the center thereof for closely receiving one of the needles 14 in a conventional fashion. The spacing between each of the protrusions 36 is substantially equal to the width defined by each protrusion 36. Thus, the protrusions 36 defined by one needle bar 12 are indexed to be closely received within the spaces defined by the protrusions 36 in the other needle bar 12. Thus, the protrusions 36 defined by each of the needle bars 12 interlock to cooperatively form the in-line needle bar arrangement 10 of the present invention.

In order to facilitate slight error in the transverse movement of the needle bars 12, the protrusions 36 are provided with beveled corners 40. As the needle bars 12 are brought into engagement one with the other, the beveled corners 40 serve to move one or both of the needle bars 12 such that they may properly register one with the other.

A needle bar spacing device 42 is provided for moving the down-line needle bar 12B out of and into engagement with the up-line needle bar 12A. The needle bar spacing device 42 is shown schematically to indicate that any conventional means suitable for so moving the needle bar may be incorporated. In the preferred embodiment illustrated in FIGS. 5–7, at least one servo motor 44 is provided for moving the needle bar 12B as required. The arrangement and connection of the servo motor 44 is such that the down-line needle bar 12B is capable of movement in the direction of arrow 30 and transversely in the direction of arrow 32. The servo motor 44 is slidably mounted on a rod 46 oriented parallel to the needle bars 12. An output shaft 48 of each servo motor 44 is fixed in position in relation to the down-line needle bar 12B, as with the engagement member 50 secured to the down-line needle bar 12B. Thus, as the output shaft 48 is pushed from the servo motor 44, the engagement member 50 causes the down-line needle bar 12B to move away from the up-line needle bar 12A. Conversely, the retraction of the output shaft 48 causes the down-line needle bar 12B to engage the up-line needle bar 12A.

Figure 5:
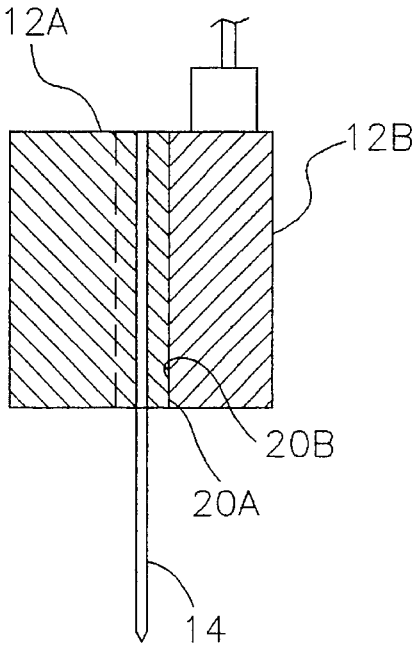
FIG. 5 is an end view, in section, of a portion of the needle bars of the present invention showing engagement between the needle bars to defining an in-line configuration thereof, the section being taken along 5—5 of FIG. 3.
Figure 6:
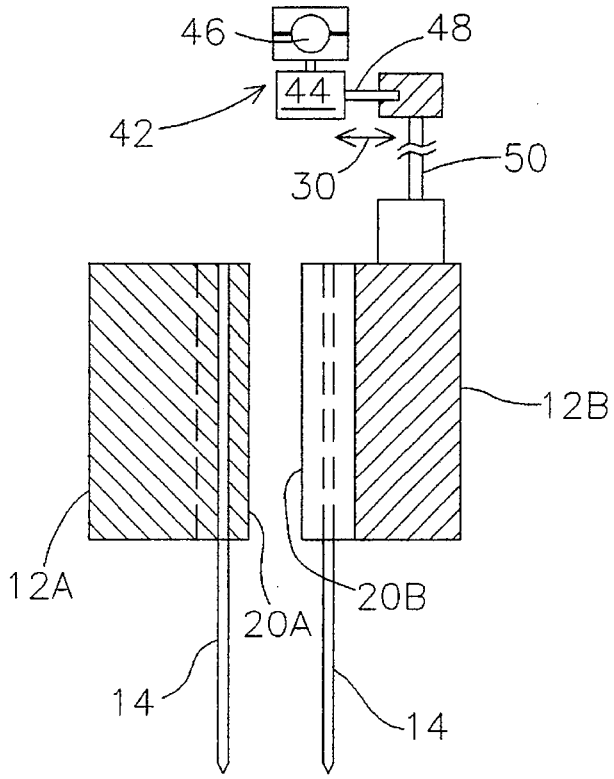
FIG. 6 is an end view, in section, of a portion of the needle bars of the present invention showing separation of the needle bars one from the other to define an in-line configuration thereof, the section being taken along 6—6 of FIG. 4.
Figure 7:
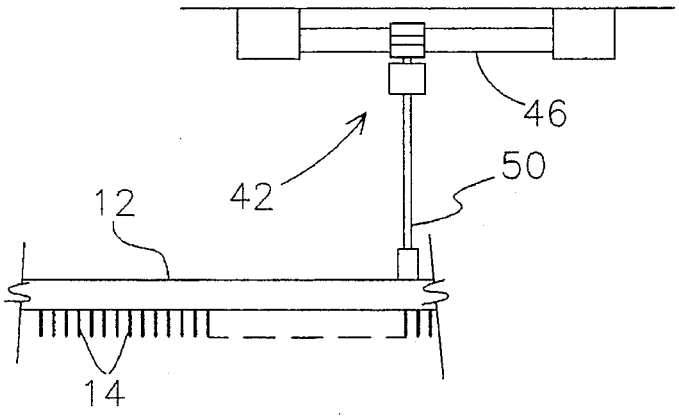
FIG. 7 is a front elevation view of a portion of the needle bars of the present invention further showing a down-line needle bar positioning device.

Schematically illustrated is a needle bar shifter 52 for shifting each of the needle bars 12A,B. In the preferred embodiment, a needle bar shifter 52A is provided for tranversely shifting the needle bar 12A and a needle bar shifter 52B is provided for shifting the needle bar 12B. It will be understood that the needle bar shifter 52 may be any conventional needle bar shifter. Further, in the preferred embodiment, the master control 24 serves to control the operation of the needle bar shifters 52A,B in conjunction with the operation of the in-line needle bar 10. FIGS. 5 and 6 are end view illustrations of the needle bars 12A,B shown in FIGS. 3 and 4, respectively, with the needle bars 12A,B being shown in engagement in FIG. 5 and out of engagement in FIG. 6. FIG. 5 further illustrates the in-line configuration of the needles 14, as only one needle 14 is visible in this view. FIG. 6 again illustrates the conventional dual needle bar arrangement which may be selectively used. Of course, as discussed previously, the disposition of the needle bars 12A,B as shown in FIG. 6 is that disposition when the transverse positioning of either or both of the needle bars 12A,B is being independently altered.

From the foregoing description, it will be recognized by those skilled in the art that an in-line needle bar arrangement offering advantages over the prior art has been provided. Specifically, the in-line needle bar provides at least two independently operable needle bars having registered faces with indexed protrusions which allow for the needles carried by each to be positioned in alternating fashion into a single row of needles. The feed rate of the yarns to the individual needles may be controlled by the implementation of at least one roller around which the yarns are engaged. Controlling the yarn feed provides an accurate method of controlling the pile height of the tufted fabric. Having a plurality of yarn feeds controllers allows for the adjustment of the pile height along a single row of tufting, which, in combination with the independent translation of the needle bars, allows for an improved finished texture of the tufted material. Specifically, the change in contour is precise, which allows for the formation of sharp corners, as opposed to transitional stitches in the prior art.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. An in-line needle bar for tufting a selected fabric, said in-line needle bar comprising:

a first needle bar for carrying a first plurality of needles, said first needle bar defining a plurality of protrusions integrally formed with said first needle bar on a first side thereof, said plurality of protrusions being vertically disposed and linearly spaced apart, said plurality of protrusions defining a space between each successive pair thereof, said space defining a width substantially equal to a width defined by each said plurality of protrusions, each of said plurality of protrusions defining a through opening oriented vertically in a central portion thereof for receiving one of said first plurality of needles, each of said plurality of protrusions further defining first and second side walls, said first and second side walls each having a planar configuration and being disposed parallel one to the other;

a second needle bar for carrying a second plurality of needles, said second needle bar defining a plurality of protrusions integrally formed with said second needle bar on a first side thereof, said plurality of protrusions being vertically disposed and linearly spaced apart, said plurality of protrusions defining a space between each successive pair thereof, said space defining a width substantially equal to a width defined by each said plurality of protrusions, each of said plurality of protrusions defining a through opening oriented vertically in a central portion thereof for receiving one of said second plurality of needles, each of said plurality of protrusions further defining first and second side walls, said first and second side walls each having a planar configuration and being disposed parallel one to the other, said first face of said second needle bar being oriented to engage said first face of said first needle bar such that said plurality of protrusions defined by said first needle bar are closely received by said spaces defined between said plurality of protrusions defined by said second needle bar, said first plurality of needles and said second plurality of needles defining a single row of needles when said first needle bar and said second needle bar are so engaged; and a needle bar spacing device for moving said second needle bar into and out of engagement with said first needle bar.

2. The in-line needle bar of claim 1 further comprising a plurality of yarn feed controllers for controlling a rate of feed of a plurality of yarns, one each of said plurality of yarns being received by one each of either of said first plurality of needles and said second plurality of needles.

3. The in-line needle bar of claim 2 wherein each of said plurality of yarn feed controllers consists of a roller for engaging a selected portion of said plurality of yarns, each said roller being controlled independently from each other said roller such that each said portion of said plurality of yarns is fed at an independent rate from each other said portion of said plurality of yarns.

4. The in-line needle bar of claim 3 further comprising a plurality of rotation imparting devices, one each of said plurality of rotation imparting devices for imparting rotation to one said roller.

5. The in-line needle bar of claim 1 further comprising:

a first needle bar shifter for transversely shifting said first needle bar; and a second needle bar shifter for transversely shifting said second needle bar, said second needle bar shifter being controlled independently of said first needle bar shifter.

6. The in-line needle bar of claim 1 wherein each of said plurality of protrusions defined by said first needle bar and said second needle bar define vertically oriented corners at a distal portion thereof, said corners being beveled to enhance engagement between said first needle bar and said second needle bar.

7. An in-line needle bar for tufting a selected fabric, said in-line needle bar comprising:

a first needle bar for carrying a first plurality of needles, said first needle bar defining a plurality of protrusions integrally formed with said first needle bar on a first side thereof, said plurality of protrusions being vertically disposed and linearly spaced apart, said plurality of protrusions defining a space between each successive pair thereof, said space defining a width substantially equal to a width defined by each said plurality of protrusions, each of said plurality of protrusions defining a through opening oriented vertically in a central portion thereof for receiving one of said first plurality of needles, each of said plurality of protrusions further defining first and second side walls, said first and second side walls each having a planar configuration and being disposed parallel one to the other;

a second needle bar for carrying a second plurality of needles, said second needle bar defining a plurality of protrusions integrally formed with said second needle bar on a first side thereof, said plurality of protrusions being vertically disposed and linearly spaced apart, said plurality of protrusions defining a space between each successive pair thereof, said space defining a width substantially equal to a width defined by each said plurality of protrusions, each of said plurality of protrusions defining a through opening oriented vertically in a central portion thereof for receiving one of said second plurality of needles, each of said plurality of protrusions further defining first and second side walls said first and second side walls each having a planar configuration and being disposed parallel one to the other, said first face of said second needle bar being oriented to engage said first face of said first needle bar such that said plurality of protrusions defined by said first needle bar are closely received by said spaces defined between said plurality of protrusions defined by said second needle bar, said first plurality of needles and said second plurality of needles defining a single row of needles when said first needle bar and said second needle bar are so engaged;

a needle bar spacing device for moving said second needle bar into and out of engagement with said first needle bar;

a plurality of yarn feed controllers for controlling a rate of feed of a plurality of yarns, one each of said plurality of yarns being received by one each of either of said first plurality of needles and said second plurality of needles;

a first needle bar shifter for transversely shifting said first needle bar; and a second needle bar shifter for transversely shifting said second needle bar, said second needle bar shifter being controlled independently of said first needle bar shifter.

8. The in-line needle bar of claim 7 wherein each of said plurality of yarn feed controllers consists of a roller for engaging a selected portion of said plurality of yarns, each said roller being controlled independently from each other said roller such that each said portion of said plurality of yarns is fed at an independent rate from each other said portion of said plurality of yarns.

9. The in-line needle bar of claim 8 further comprising a plurality of rotation imparting devices, one each of said plurality of rotation imparting devices for imparting rotation to one said roller.

10. The in-line needle bar of claim 7 wherein each of said plurality of protrusions defined by said first needle bar and said second needle bar define vertically oriented corners at a distal portion thereof, said corners being beveled to enhance engagement between said first needle bar and said second needle bar.

11. The in-line needle bar of claim 7 further comprising a master control for controlling each of said plurality of yarn feed controllers, said needle bar spacing device, said first needle bar shifter and said second needle bar shifter.

12. An in-line needle bar for tufting a selected fabric, said in-line needle bar comprising:

a first needle bar for carrying a first plurality of needles, said first needle bar defining a plurality of protrusions integrally formed with said first needle bar on a first side thereof, said plurality of protrusions being vertically disposed and linearly spaced apart, said plurality of protrusions defining a space between each successive pair thereof, said space defining a width substantially equal to a width defined by each said plurality of protrusions, each of said plurality of protrusions defining a through opening oriented vertically in a central portion thereof for receiving one of said first plurality of needles, each of said plurality of protrusions further defining first and second side walls, said first and second side walls each having a planar configuration and being disposed parallel one to the other;

a second needle bar for carrying a second plurality of needles, said second needle bar defining a plurality of protrusions integrally formed with said second needle bar on a first side thereof, said plurality of protrusions being vertically disposed and linearly spaced apart, said plurality of protrusions defining a space between each successive pair thereof, said space defining a width substantially equal to a width defined by each said plurality of protrusions, each of said plurality of protrusions defining a through opening oriented vertically in a central portion thereof for receiving one of said second plurality of needles, each of said plurality of protrusions further defining first and second side walls, said first and second side walls each having a planar configuration and being disposed parallel one to the other, said first face of said second needle bar being oriented to engage said first face of said first needle bar such that said plurality of protrusions defined by said first needle bar are closely received by said spaces defined between said plurality of protrusions defined by said second needle bar, said first plurality of needles and said second plurality of needles defining a single row of needles when said first needle bar and said second needle bar are so engaged;

a needle bar spacing device for moving said second needle bar into and out of engagement with said first needle bar;

a plurality of yarn feed controllers for controlling a rate of feed of a plurality of yarns, one each of said plurality of yarns being received by one each of either of said first plurality of needles and said second plurality of needles;

a first needle bar shifter for transversely shifting said first needle bar;

a second needle bar shifter for transversely shifting said second needle bar, said second needle bar shifter being controlled independently of said first needle bar shifter; and a master control for controlling each of said plurality of yam feed controllers, said needle bar spacing device, said first needle bar shifter and said second needle bar shifter.

13. The in-line needle bar of claim 12 wherein each of said plurality of yarn feed controllers consists of a roller for engaging a selected portion of said plurality of yarns, each said roller being controlled independently from each other said roller such that each said portion of said plurality of yarns is fed at an independent rate from each other said portion of said plurality of yarns.

14. The in-line needle bar of claim 13 further comprising a plurality of rotation imparting devices, one each of said plurality of rotation imparting devices for imparting rotation to one said roller.

15. The in-line needle bar of claim 12 wherein each of said plurality of protrusions defined by said first needle bar and said second needle bar define vertically oriented corners at a distal portion thereof, said corners being beveled to enhance engagement between said first needle bar and said second needle bar.

* * * * *